United States Patent [19]

Ichijima et al.

[11] Patent Number: 4,480,052

[45] Date of Patent: Oct. 30, 1984

[54] HEAT-SENSITIVE RECORDING MATERIALS

[75] Inventors: Seiji Ichijima; Nobutaka Ohki; Masato Satomura; Ken Iwakura, all of Kanagawa, Japan

[73] Assignee: Fuji Photo Film Co., Ltd., Kanagawa, Japan

[21] Appl. No.: 427,036

[22] Filed: Sep. 29, 1982

[30] Foreign Application Priority Data

Oct. 2, 1981 [JP] Japan ..... 56-157795

[51] Int. Cl.[3] ..... B41M 5/18

[52] U.S. Cl. ..... 346/208; 346/209

[58] Field of Search ..... 282/27.5; 427/150, 151; 428/320.8, 488, 537, 913, 914, 411, 341, 342

[56] References Cited

FOREIGN PATENT DOCUMENTS 57-8194 1/1982 Japan ..... 503/208

57-14094 1/1982 Japan ..... 503/209

*Primary Examiner*—Bruce H. Hess

*Attorney, Agent, or Firm*—Sughrue, Mion, Zinn, Macpeak and Seas

[57] ABSTRACT

A heat-sensitive recording material is disclosed. The material is comprised of an electron donating colorless dye and electron accepting compound in combination with a phenol derivative. The inclusion of the phenol derivative as disclosed by applicants results in producing increased color density and sensitivity. Furthermore, the resulting material does not suffer from increased fogging and produces a color image which has sufficient fastness.

15 Claims, No Drawings

HEAT-SENSITIVE RECORDING MATERIALS

FIELD OF THE INVENTION

The present invention relates to heat-sensitive recording materials and particularly to heat-sensitive recording materials having improved color developing properties.

BACKGROUND OF THE INVENTION

Heat-sensitive recording materials comprising an electron donating colorless dye and an electron accepting compound have been disclosed in Japanese Patent Publication Nos. 14039/70 (corresponding to U.S. Pat. No. 3,539,375) and 4160/68 (corresponding to U.S. patent application Ser. No. 512,546). Such heat-sensitive recording materials must have at least the following characteristics: (1) the color density and the color sensitivity must be sufficiently high; (2) fogging (coloration during preservation before using) is not caused; and (3) the colors developed have sufficient fastness. However, present recording materials do not completely satisfy these requirements.

Recently, studies concerning the above described requirement (1) have been carried out due to recently developed high speed heat-sensitive recording systems.

In order to meet requirement (1), one approach has been to elevate the melting point of the electron accepting compound from 60° C. to 100° C. However, in phenolic compounds which have been widely used at present as the electron acceptable compounds, it is difficult to control the melting point. Further, the phenolic compounds have little practical value because they are expensive.

Other approaches have been described in Japanese Patent Publication Nos. 17748/74 and 39567/76. These approaches involve the use of a combination of an organic acid and a phenolic compound as an electron accepting material or the use of polyvalent metal salts of compounds having an alcoholic hydroxy group. Further, it has been described in Japanese Patent Publication No. 29945/76 to use hydroxyethyl cellulose and a copolymer of maleic acid anhydride salt.

Further, the addition of waxes has been described in Japanese Patent Publication No. 27599/76 and Japanese patent application (OPI) No. 19231/73 (the term "OPI" as used herein refers to a "published unexamined Japanese patent application").

Additional approaches have been described in Japanese patent application (OPI) Nos. 34842/74, 115554/74, 149353/75, 106746/77, 5636/78, 11036/78, 48751/78 and 72996/81. These approaches involve adding nitrogen containing organic compounds such as thioacetanilide, phthalonitrile, acetamide, di-β-naphthyl-p-phenylenediamine, aliphatic acid amide, acetoacetanilide, diphenylamine, benzamide or carbazole, etc., thermoplastic substances such as 2,3-m-tolylbutane or 4,4'-dimethylbiphenyl, etc. or carboxylic acid esters such as dimethyl isophthalate, diphenyl phthalate or dimethyl terephthalate, etc. as a sensitizer.

However, the heat-sensitive recording materials produced by the above described techniques are insufficient with respect to color density and the color sensitivity.

SUMMARY OF THE INVENTION

Accordingly, an object of the present invention is to provide heat-sensitive recording materials which have a sufficient color density and sensitivity.

The objects of the present invention have been attained by providing heat-sensitive recording materials comprising an electron donating colorless dye, an electron accepting compound and a phenol derivative represented by the following general formula (I):

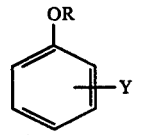

(I)

wherein R represents an alkyl group or an aralkyl group, and Y represents a phenyl group, an alkyl group, a cycloalkyl group or a halogen atom.

DETAILED DESCRIPTION OF THE INVENTION

In the above described general formula (I), it is preferred that the alkyl group represented by R has 1 to 20 carbon atoms, more preferably, 1 to 10 carbon atoms. It is preferred that the aralkyl group has 7 to 20 carbon atoms.

Particularly preferred examples thereof include a benzyl group and a phenethyl group.

That is, in the above described general formula (I), the following phenol derivative represented by the following general formula (II) or (III) is more preferred:

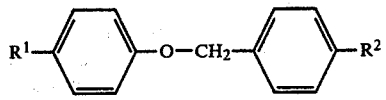

(II)

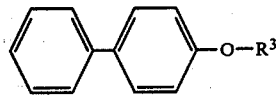

(III)

wherein $R^1$ represents an alkyl group having 1 to 5 carbon atoms, $R^2$ represents a hydrogen atom or an alkyl group having 1 to 5 carbon atoms and $R^3$ represents an alkyl group having 1 to 5 carbon atoms, a halogenated alkyl group having 1 to 5 carbon atoms, a benzyl group or a phenethyl group.

When $R^3$ represents the halogenated alkyl group, a chlorine or bromine atom is preferred as the halogen atom and in the benzyl group or the phenethyl group represented by $R^3$, those may be substituted by one or more alkyl groups having 1 to 5 carbon atoms.

In the above described general formula (I), it is preferred that the alkyl group represented by Y has 1 to 15 carbon atoms, more preferably 1 to 8 carbon atoms.

Preferred examples of the cycloalkyl group represented by Y include a cyclohexyl group and a cyclopentyl group.

Chlorine is preferred as the halogen atom represented by Y.

In phenol derivatives represented by the general formula (I) according to the present invention, the substituent represented by Y may be situated at any position (ortho, meta or para). However, para-substituent derivatives are particularly preferred.

Among the above described phenol derivatives, those having a melting point of 40° C. to 150° C. are preferred and those having a meiting point of 50° C. to 120° C. are particularly preferred.

The heat-sensitive recording materials containing the phenol derivative represented by the general formula (I) according to the present invention yield a sufficient color density and have a sufficient color sensitivity. The materials also unergo less deterioration of color sensitivity with the passage of time. Further, they do not cause fogging, and the fastness of the developed materials after development is sufficient.

In the following, examples of the phenol derivative according to the present invention are described, but the present invention is not limited to them.

(1) p-Tolyl p-chlorobenzyl ether
(2) p-Tolyl p-isopropylbenzyl ether
(3) p-t-Butylphenyl benzyl ether
(4) p-t-Butylphenyl p-isopropylbenzyl ether
(5) p-t-Amylphenyl benzyl ether
(6) p-t-Amylphenyl p-isopropyl benzyl ether
(7) p-Octylphenyl benzyl ether
(8) p-t-Octylphenyl p-isopropylbenzyl ether
(9) n-Hexyl p-biphenyl ether
(10) n-Octyl p-biphenyl ether
(11) 4-Bromobutyl p-biphenyl ether
(12) 5-Chloroamyl p-biphenyl ether
(13) p-Isopropylbenzyl p-biphenyl ether
(14) β-Phenethyl p-biphenyl ether
(15) α-Phenethyl-p-biphenyl ether
(16) β-Ethoxyethyl p-biphenyl ether
(17) β-n-Butoxyethyl p-biphenyl ether
(18) p-Cyclohexylphenyl benzyl ether
(19) p-Cyclohexylphenyl p-isopropylbenzyl ether In the above examples, the phenol derivatives (4), (5), (11), (13), (14) and (15) are most preferable.

Examples of the electron donating colorless dyes used in the present invention are triarylmethane compounds, diphenylmethane compounds, xanthene compounds, thiazine compounds and spiropyran compounds. Triarylmethane compounds and xanthene compounds are more preferred.

Examples of triarylmethane compounds include 3,3-bis-(p-dimethylaminophenyl)-6-dimethylaminophthalide (i.d. Crystal Violet lactone), 3,3-bis-(p-dimethylaminophenyl)phthalide, 3-(p-dimethylaminophenyl)-3-(1,3-dimethylindol-3-yl)phthalide and 3-(p-dimethylaminophenyl)-3-(2-methylindol-3-yl)phthalide.

Examples of diphenylmethane compounds include 4,4'-bis-dimethylaminobenzohydrin benzyl ether, N-halophenyl leuco Auramine, and N-2,4,5-trichlorophenyl leuco Auramine.

Examples of xanthene compounds include Rhodamine B anilinolactam, Rhodamine (p-nitroanilino)lactam, Rhodamine B (p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-butylamino-3-chloro-6-diethylaminofluoran, 2-ethoxyethylamino-3-chloro-6-diethylaminofluoran, 2-anilino-3-chloro-6-diethylaminofluoran, 2-diphenylamino-6-diethylaminofluoran, 2-anilino-3-methyl-6-diphenylaminofluoran and 2-phenyl-6-diethylaminofluoran.

Examples of thiazine compounds include benzoyl leuco Methylene Blue and p-nitrobenzyl leuco Methylene Blue.

Examples of spiropyran compounds include 3-methylspiro-dinaphthopyran, 3-ethylspiro-dinaphthopyran, 3,3'-dichloro-spiro-dinaphthopyran, 3-benzylspiro-dinaphthopyran, 3-methyl-naphtho-(3-methoxybenzo)spiropyran and 3-propyl-spiro-dibenzopyran.

Any of the above referred to compounds may be used alone or in combination with one another.

Examples of useful electron accepting compounds include phenol compounds, organic acids and salts thereof and oxybenzoic acid esters. Particularly, phenol compounds are preferably used, because they have a melting point near the desired recording temperature. Such compounds are described in detail in, for example, Japanese Patent Publication Nos. 14039/70, 29830/76, and U.S. Pat. Nos. 3,244,549 and 3,244,550. Examples of them include 4-tertiary-butylphenol, 4-phenylphenol, 4-hydroxydiphenoxide, α-naphthol, β-naphthol, methyl-4-hydroxybenzoate, 2,2'-dihydroxybiphenyl, 2,2-bis-(4-hydroxyphenyl)propane (bisphenol A), 4,4'-isopropylidenebis-(2-methylphenol), 4,4'-secondary-isobutylidenediphenol and 4-hydroxybenzoic acid benzyl ester. Of the examples, 2,2-bis-(4-hydroxyphenyl)-propane (bisphenol A) is most preferred.

In the heat-sensitive recording material according to the present invention which contain one kind of phenol derivative or if required, more kinds of the phenol derivatives represented by the above described general formula (I), it is possible to use compounds having a low melting point such as stearic acid amide other than the phenol derivatives represented by the general formula (I).

In the following, embodiments of the process for producing the heat-sensitive recording materials are described.

The most general process for producing the heat-sensitive recording materials will be described first. The above described electron donating colorless dye and the electron accepting compound were dispersed, respectively, in a 1 to 10 wt%, preferably 2 to 8 wt%, aqueous solution of high polymer by means such as a ball mill or a sand mill.

Preferred examples of high polymer include a polyvinyl alcohol (PVA), a methylcellulose, a hydroxyethylcellulose, an acryl amide series copolymer and a latex. Of the above high polymers, the polyvinyl alcohol is most preferably used. The molecular weight of the polyvinyl alcohol ranges from 1,000 to 20,000, preferably, 1,500 to 10,000.

After the blending was completed, the inorganic pigments such as kaolin, talc or calcium carbonate, etc. were added to produce a coating solution. If necessary, paraffin wax emulsions, latex binders, sensitizers, metal soaps and ultraviolet ray absorbers may be added to the coating solution.

Generally, the coating solution is applied to a paper base.

The coating amount is general 2 to to 10 g/m$^2$, preferably 4 to 8 g/m$^2$, as a solid content. The lower limit depends upon a color density when heated, and the upper limit depend chiefly upon economic restriction.

The amount of the phenol derivative used in the present invention is 0.1 to 4.0 g/m$^2$, preferably 0.2 to 2.0 g/m$^2$, and more preferably 0.3 to 1.5 g/m$^2$. The colorless dye is used in an amount of 0.1 to 2.0 g/m$^2$, preferably 0.2 to 1.0 g/m$^2$ and the electron accepting compound is used in an amount of 0.1 to 4.0 g/m$^2$, preferably 0.5 to 2.0 g/m$^2$.

The following is a detailed description of a specific example which was prepared. However, the present invention is not limited to the example.

It is obvious from this viewpoint, too, that heat-sensitive recording materials of the present invention are excellent.

It clearly appears as though the inclusion of a phenol derivative in making a coating for a heat-sensitive material makes it possible to achieve the objects of the present invention.

TABLE 1

| Sample No. | Electron Donating Colorless Dye | Electron Accepting Compound | Phenol Derivative | 35 mJ/mm$^2$ Color Density | Fog Density |
|---|---|---|---|---|---|
| 1 | 2-Anilino-3-chloro-6-diethylaminofluoran | 2,2-Bis-(4-hydroxyphenyl)propane | β-Phenethyl-p-biphenyl ether | 1.05 | 0.07 |
| 2 | 2-Anilino-3-methyl-6-diethylaminofluoran | 4-Hydroxybenzoic acid benzyl ester | β-Phenethyl-p-biphenyl ether | 1.03 | 0.08 |
| 3 | 2-o-Chloroanilino-6-diethylaminofluoran | 2,2-Bis-(4-hydroxyphenyl)propane | β-Phenethyl-p-biphenyl ether | 1.00 | 0.05 |
| 4 | 2-Anilino-3-chloro-6-diethylaminofluoran | 2,2-Bis-(4-hydroxyphenyl)propane | p-t-Amilphenyl benzyl ether | 1.03 | 0.06 |
| 5 | 2-Anilino-3-chloro-6-diethylaminofluoran | 2,2-Bis-(4-hydroxyphenyl)propane | 4-Bromobutyl-p-biphenyl ether | 1.05 | 0.07 |
| 6 | 2-Anilino-3-chloro-6-diethylaminofluoran | 2,2-Bis-(4-hydroxyphenyl)propane | p-t-Butylphenyl-p-isopropyl benzyl ether | 1.01 | 0.06 |
| Comparative Sample | | | | | |
| 1 | 2-Anilino-3-chloro-6-diethylaminofluoran | 2,2-Bis-(4-hydroxyphenyl)propane | Stearic acid amide | 0.52 | 0.08 |
| 2 | 2-Anilino-3-chloro-6-diethylaminofluoran | 2,2-Bis-(4-hydroxyphenyl)propane | — | 0.35 | 0.05 |

EXAMPLE (1) Production of Samples 1 to 6

5 g of the electron donating colorless dye shown in Table 1 was dispersed in 50 g of a 5% aqueous solution of polyvinyl alcohol (saponification value: 99%; degree of polymerization: 1000) by means of a ball mill for about 24 hours. On the other hand, 20 g of the electron accepting compound (phenols) shown in Table 1 was dispersed similarly in 200 g of a 5% aqueous solution of polyvinyl alcohol by means of a ball mill for about 24 hours. Further, 20 g of the phenol derivative shown in Table 1 was dispersed in a 5% aqueous solution of polyvinyl alcohol by means of a ball mill for about 24 hours. After these three dispersions were blended, 20 g of kaolin (Georgia Kaolin) was added thereto and dispersed therein. Further, 5 g of a 50% paraffin wax emulsion (Chukyo Yushi Cellosol #428) was added thereto to produce a coating solution.

The coating solution was applied to a paper base having an areal weight of 50 g/m$^2$ so as to result in a solid coating amount of 6 g/m$^2$. After the coating was dried at 60° C. for 1 minute, it was treated with a supercalender at a linear pressure of 60 kg W/cm to obtain a coated paper.

The coated paper was thermally developed at a heat energy of 35 mJ/mm$^2$ by means of a facsimile receiving set (Type EF-22, made by Matsushita Denso Co., Ltd.), and the color density was determined.

The results are shown in Table 1.

(2) Production of Comparative Samples 1 to 2

The same examination was carried out using the same composition as in Samples 1 to 6, except that the compound shown in Table 1 was used instead of the aryl ether compound. The results are shown in Table 1.

It is understood from Table 1 that the recording materials according to the present invention have high sensitivity. Further, when the fog density in Table 1 exceeds 0.13, the commercial value deteriorates remarkably.

The above results clearly show that greater color density can be obtained when a phenol derivative of the invention is used. Furthermore, the results also show the increased color density is not accompanied by an undesirable increase in fog density.

While the invention has been described in detail and with reference to specific embodiment thereof, it will be apparent to one skilled in the art that various changes and modifications can be made therein without departing from the spirit and scope thereof.

What is claimed is:

1. A heat-sensitive recording material, comprising: a support and a composition thereon comprising:

an electron donating colorless dye in an amount of 0.1 to 2.0 g/m$^2$;

an electron accepting compound in an amount of 0.1 to 4.0 g/m$^2$; and a phenol derivative in an amount of 0.1 to 4.0 g/m$^2$ and represented by the general formula (I):

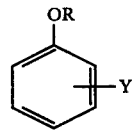

(I)

wherein R is an alkyl group or an aralkyl group, and Y is a phenyl group, an alkyl group, a cycloalkyl group or a halogen atom.

2. A heat-sensitive recording material, as claimed in claim 1, wherein the phenol derivative is selected from the group consisting of the following general formula (II) or (III):

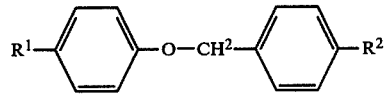

(II)

-continued (III)

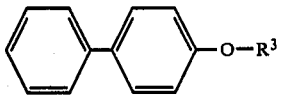

wherein $R^1$ represents an alkyl group having 1 to 5 carbon atoms, $R^2$ represents a hydrogen atom or an alkyl group having 1 to 5 carbon atoms and $R^3$ represents an alkyl group having 1 to 5 carbon atoms, a halogenated alkyl group having 1 to 5 carbon atoms, a benzyl group or a phenethyl group.

3. A heat-sensitive recording material, as claimed in any of claim 1 or 2, wherein the phenol derivative has a melting point of about 40° C. to about 150° C.

4. A heat-sensitive recording material, as claimed in any of claims 1 or 2, wherein the phenol derivative has a melting point of about 50° C. to 120° C.

5. A heat-sensitive recording material, as claimed in claim 1, wherein R is an alkyl group having 1 to 20 carbon atoms.

6. A heat-sensitive recording material, as claimed in claim 1, wherein when R is an aralkyl group it has 7 to 20 carbon atoms.

7. A heat-sensitive recording material, as claimed in claim 6, wherein R is selected from the group consisting of a benzyl group and a phenethyl group.

8. A heat-sensitive recording material, as claimed in claim 1, wherein when R is an alkyl group it has 1 to 15 carbon atoms.

9. A heat-sensitive recording material, as claimed in claim 1, wherein Y is a phenyl group.

10. A heat-sensitive recording material, as claimed in claim 1, wherein Y is an alkyl group.

11. A heat-sensitive recording material, as claimed in claim 10, the alkyl group has 1 to 15 carbon atoms.

12. A heat-sensitive recording material, as claimed in claim 1, wherein Y is a cycloalkyl group.

13. A heat-sensitive recording material, as claimed in claim 12, wherein the cycloalkyl group is selected from the group consisting of a cyclohexyl group and a cyclopentyl group.

14. A heat-sensitive recording material, as claimed in claim 1, wherein Y is a halogen atom.

15. A heat-sensitive recording material, as claimed in claim 14, wherein the halogen atom is a chlorine atom.

* * * * *